US006430379B1

(12) United States Patent
Takahashi et al.

(10) Patent No.: US 6,430,379 B1
(45) **Date of Patent: *Aug. 6, 2002**

(54) IMAGE FORMING APPARATUS USING INTERMEDIATE TRANSFER MEDIUM

(75) Inventors: Masaaki Takahashi; Naoto Yoshino; Masao Ohkubo; Takashi Kawabata; Yukio Hayashi; Yoko Miyamoto; Makoto Katayama, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/651,725

(22) Filed: Aug. 30, 2000

(30) Foreign Application Priority Data

Oct. 21, 1999 (JP) ..... 11-299875

(51) Int. Cl.[7] ..... G03G 15/00

(52) U.S. Cl. ..... 399/44; 399/101; 399/302; 399/313

(58) Field of Search ..... 399/44, 66, 100, 399/101, 297, 313, 314, 148, 302, 310

(56) References Cited

U.S. PATENT DOCUMENTS 4,026,648 A * 5/1977 Takahashi ..... 399/101
4,360,262 A * 11/1982 Genthe ..... 399/148
5,799,229 A * 8/1998 Yokoyama et al. ..... 399/100
6,175,711 B1 * 1/2001 Yoshino et al. ..... 399/297

FOREIGN PATENT DOCUMENTS

| | | |
|---|---|---|
| JP | 8-272235 | 10/1996 |
| JP | 8-328401 | 12/1996 |
| JP | 9-6146 | 1/1997 |

* cited by examiner

*Primary Examiner*—Joan Pendegrass
(74) *Attorney, Agent, or Firm*—Morgan, Lewis & Bockius LLP

(57) ABSTRACT

An intermediate transfer type image forming apparatus is provided, in which a secondary transfer unit includes a secondary transfer member having a contact transfer member disposed in contact with at least the surface of an intermediate transfer medium, a bias applying unit for applying a transfer bias to transfer a toner image on the intermediate transfer medium through the secondary transfer member to a transfer medium and an inverse transfer bias having the opposite polarity to the transfer bias, and a bias switching unit for switching the applied bias of the bias applying unit so that the transfer bias is applied to an image transfer area on the intermediate transfer medium and the inverse transfer bias is applied to an image non-transfer area on the intermediate transfer medium. The apparatus is also equipped with a disturbing member for disturbing (scraping out, sweeping off or the like) toner adhering to the contact transfer member.

14 Claims, 11 Drawing Sheets

IMAGE FORMING APPARATUS USING INTERMEDIATE TRANSFER MEDIUM

BACKGROUND OF THE INVENTION

1. Field of the Invention

The present invention relates to an intermediate transfer type image forming apparatus for transferring plural toner images onto an intermediate transfer medium while superposing the toner images on the intermediate transfer medium, and then collectively transferring these toner images on a transfer medium, and particularly to an improvement of such a type of an image forming apparatus that the transfer of a toner image from an intermediate transfer medium to a transfer medium is carried out in a contact transfer mode.

2. Description of the Related Art

There has been known a conventional intermediate transfer type image forming apparatus equipped with photosensitive drums on which toner images corresponding to electrostatic latent images of respective color components are respectively formed, an intermediate transfer belt (intermediate transfer medium) onto which the toner images on the respective photosensitive drums are successively and intermediately transferred, a primary transfer device for transferring the toner images on the photosensitive drums onto the intermediate transfer belt, and a secondary transfer device for collectively transferring the toner images on the intermediate transfer belt onto a sheet (transfer medium).

Here, for example, a transfer roll or the like which is disposed in contact with the intermediate transfer belt is used as the secondary transfer device. The transfer roll serves to form an electric field between the intermediate transfer belt and the transfer roll to move the toner images on the intermediate transfer belt to a sheet side.

It has been known in some of the above type image forming apparatuses that an image quality adjusting image for adjusting image density, image registration, etc. is formed in an area between images on the intermediate transfer belt (inter-image area) or the like.

In this case, when the image quality adjusting image on the intermediate transfer belt is passed through a facing portion to the transfer roll, the image quality adjusting image would be transferred onto the transfer roll if the electric field for moving a toner image on the intermediate transfer belt to the sheet side is kept to be formed between the transfer roll and the intermediate transfer belt, so that the surface of the transfer roll is soiled by the image quality adjusting image. Therefore, there occurs such a situation that the image quality adjusting image is re-transferred to the back surface of a next sheet to soil the back surface of the sheet when the next sheet is passed.

Accordingly, there has been proposed such a technique that a bias (transfer bias) for forming an electric field directing to move a toner image on the intermediate transfer belt to the sheet side is applied while the sheet is passed through the facing portion to the transfer roll, and a bias (inverse transfer bias) for forming an electric field directing in the opposite direction to the electric field produced by the transfer bias is applied when the sheet is not passed through the facing portion to the transfer roll, thereby preventing the transfer of the toner image in the inter-image portion (image non-transfer area onto the transfer roll (see Japanese Laid-open Patent Application Nos. Hei-8-272235/1996, Hei-8-328401/1996, Hei-9-6146/1997).

Following a recent requirement of further enhancing high image quality, the number of the types of image quality adjusting images to be formed in the inter-image portion on the intermediate transfer belt has been increasing, and the image area required to form an image quality adjusting image has also been increasing. That is, toner amount constituting an image quality adjusting image has been increasing.

Accordingly, it is difficult to perfectly prevent the transfer of the image quality adjusting image onto the transfer roll by merely applying the inverse transfer bias as described above, and thus there occurs such a technical problem that the image quality adjusting image is transferred onto the transfer roll to soil the surface of the transfer roll, and the image quality adjusting image thus transferred is transferred to the back surface of a next sheet to soil the back surface of the next sheet when the next sheet is passed by the transfer roll.

In order to avoid such a problem, there has been known a technique of pressing a blade against the transfer roll to scrape out the toner transferred onto the surface of the transfer roll, thereby avoiding the back surface of the sheet from being soiled.

However, in such a case, the blade must be pressed against the transfer roll under high pressure, resulting in occurrence of such another technical problem that the surface of the transfer roll is worn out and shorten the lifetime thereof, or the blade is tucked up and damaged under a high humidity atmosphere.

As a similar technique has been known such a technique that a conductive brush roll is disposed in contact with a transfer roll, and toner on the transfer roll is electrostatically adsorbed by the conductive brush to thereby avoiding the soil problem of the back surface of the sheet. Here, the conductive brush forms an electrostatic electric field by grounding the brush or applying a bias to it, whereby the toner is electrostatically adsorbed by the conductive brush.

However, in this case, charged toner is kept to be attached to the conductive brush, that is, the toner is trapped in the conductive brush, and thus the toner thus trapped is re-transferred to the transfer roll, so that the surface of the transfer roll is soiled and the toner is re-transferred from the soiled transfer roll to a next sheet to soil the back surface of the next sheet when the next sheet is passed.

In order to remove the toner trapped in the conductive brush, there may be provided a scraping member which abuts against the conductive brush to scrape the toner off the conductive brush. However, since the scraping member is brought into contact with the conductive brush at all times, the conductive brush is worn out, so that the back surface of the sheet is soiled.

SUMMARY OF THE INVENTION

In order to solve the above problems, the present invention aims to provide an image forming apparatus which can effectively prevent a next transfer medium from being soiled by an image quality adjusting image transferred to a contact transfer member such as a transfer roll or the like.

The image forming apparatus according to the present invention has an image carrier on which a toner image corresponding to image information is formed, an intermediate transfer medium disposed to face the image carrier, a primary transfer unit that transfers the toner image on the image carrier onto the intermediate transfer medium, and a secondary transfer unit that transfers the toner image on the intermediate transfer medium onto a transfer medium. The secondary transfer unit includes a secondary transfer member having a contact transfer member which is disposed in contact with at least the surface of the intermediate transfer medium, a bias applying unit that applies a transfer bias to transfer the toner image on the intermediate transfer medium through the secondary transfer member to the transfer medium and an inverse transfer bias having the opposite polarity to the transfer bias, and a bias switching unit which switches the bias to be applied by the bias applying unit to apply the transfer bias to an image transfer area on the intermediate transfer medium and apply the inverse transfer bias to at least a part of an image non-transfer area on the intermediate transfer medium. The image forming apparatus further has a disturbing member which is formed of an insulator disposed in contact with the contact transfer member and disturbs the toner adhering to the contact transfer member.

DETAILED DESCRIPTION OF THE PREFERRED EMBODIMENTS

Preferred embodiments according to the present invention will be described hereunder in detail with reference to the accompanying drawings.

Before describing each embodiment, a basic configuration of the image forming apparatus according to the present invention is explained.

Figure 1:
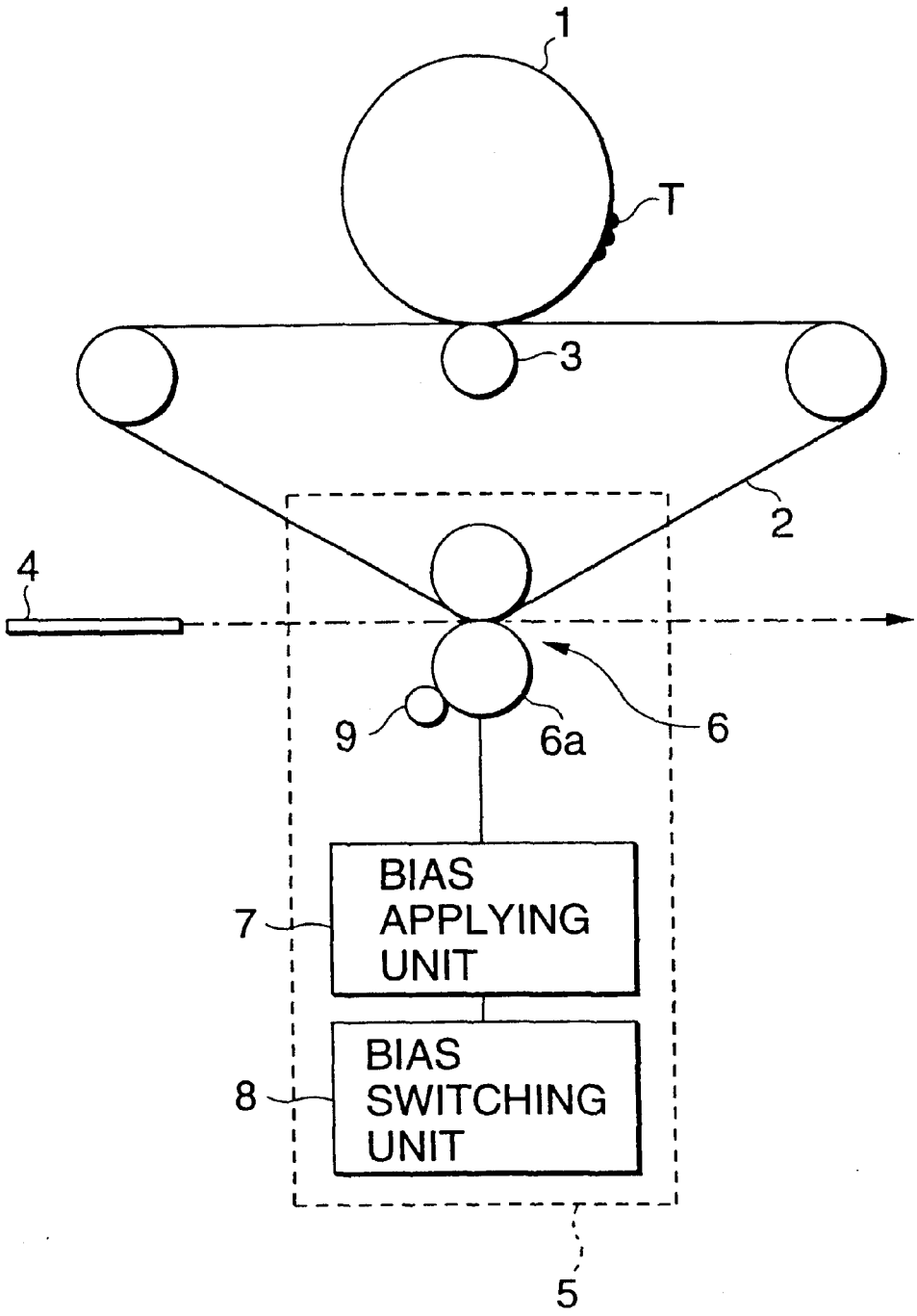
FIG. 1 schematically shows an image forming apparatus according to the present invention.

As shown in FIG. 1, the image forming apparatus includes an image carrier 1 on which a toner image T corresponding to image information is formed, an intermediate transfer medium 2 disposed so as to face the image carrier 1, a primary transfer unit 3 for transferring the toner image T on the image carrier 1 onto the intermediate transfer medium 2, and a secondary transfer unit 5 for transferring the toner image T on the intermediate transfer medium 2 onto a transfer medium 4, wherein the secondary transfer unit 5 includes a secondary transfer member 6 having a contact transfer member 6*a* which is disposed in contact with at least the surface of the intermediate transfer medium 2, a bias applying unit 7 for a transfer bias for transferring the toner image T on the intermediate transfer medium 2 through the secondary transfer member 6 to the transfer medium 4 and an inverse transfer bias having the opposite polarity to the transfer bias, and a bias switching unit 8 for switching a bias to be applied of the bias applying unit 7 so that the transfer bias is applied to an image transfer area on the intermediate transfer medium 2, and the inverse transfer bias is applied to at least a part of an image non-transfer area on the intermediate transfer medium 3, is characterized by further including a disturbing member 9 which is formed of an insulator disposed in contact with the contact transfer member 6*a* and serves to disturb the toner adhering to the contact transfer member 6*a*.

The image forming apparatus is not limited to such mode that one image carrier 1 is rotated at plural times to successively transfer toner images T of respective colors onto the intermediate transfer medium 2, however, it may be applied to such a mode that plural image carriers 1 are provided (for example, four image carriers are arranged in juxtaposition with one another to transfer toner, images T of respective colors onto the intermediate transfer medium 2).

Further, any member may be used as the image carrier 1 insofar the surface thereof has a photosensitive member, a dielectric member or the like and the toner image T is carried thereon, and any shape such as a drum shape, a belt shape or the like may be used for the image carrier 1. In addition, an electrophotographic system, an electrostatic recording system or the like may be suitable selected as the manner of forming the toner image T insofar as at least the toner image T can be formed.

The shape of the intermediate transfer medium 2 may be a belt shape, a drum shape or the like.

Any transfer manner may be suitably selected for the primary transfer unit 3 insofar as it can transfer the toner image 1 from the image carrier 1 onto the intermediate transfer medium 2, and any one of a contact transfer system and a non-contact transfer system may be suitably used.

The secondary transfer unit 5 includes a secondary transfer member 6 having a contact transfer member 6*a* disposed in contact with at least the surface of the intermediate transfer medium 2, a bias applying unit 7 for applying a transfer bias for transferring a toner image T on the intermediate transfer medium 2 through the secondary transfer member 6 onto the transfer medium 4 and an inverse transfer bias having the opposite polarity to the transfer bias, and a bias switching unit 8 for switching the applied bias of the bias applying unit 7 so that the transfer bias is applied to the image transfer area on the intermediate transfer medium 2 and the inverse transfer bias is applied to at least a part of the image non-transfer area on the intermediate transfer medium 2, and thus the secondary transfer unit 5 is based on the non-contact transfer system.

Here, in such a mode that the belt shape is adopted for the intermediate transfer medium 2, the secondary transfer member 6 is constructed by a contact transfer member 6*a* formed of a transfer roll or the like and a counter roll disposed so as to face the transfer roll through the intermediate transfer belt, and also in such a mode that the drum shape is adopted for the intermediate transfer medium 2, the secondary transfer member 6 is constructed by a contact transfer member 6*a* formed of a transfer roll or the like and a base member of the intermediate transfer drum (for example, metal elementary pipe).

The switching timing between the transfer bias application and the inverse transfer bias application by the bias application unit 7 and the bias switching unit 8 is determined by suitably selecting and using one of a manner of estimating on the basis of an image forming signal the timing at which the transfer medium 4 is passed through the secondary transfer portion and a manner of estimating on the basis of a feeding signal of the transfer medium 4 the timing at which the transfer medium 4 is passed through the secondary transfer portion.

Further, any member may be suitably selected as the disturbing member 9 insofar as it is formed of an insulator, disposed in contact with the contact transfer member 6*a* and has a function of disturbing toner adhering to the contact transfer member 6*a*. However, from the viewpoint of preventing adhesion and trap of toner to/at the disturbing member 9, the disturbing member 9 is preferably formed of material which is charged at the same polarity as the toner with which the toner image T is formed.

From the viewpoint of enabling the toner to be easily disturbed, the disturbing member 9 is preferably formed of a brush roll which is disposed rotatably.

Here, in the case where the brush roll is used as the disturbing member 9, it is preferable that a bundle of the bristles of the brush is planted spirally with respect to the rotational direction. The planting density of the brush roll is preferably set to a value in the range from 3875 bristles/cm2 to 6200 bristles/$cm^2$.

Further, from the viewpoint of suppressing the rotational load and the abrasion of the contact transfer member 6*a*, it is preferable that the brush roll is rotated in the same direction as the contact transfer member 6*a* at the facing portion thereof to the contact transfer member 6*a*, and in this case, the peripheral velocity of the brush roll is set to be two or more times as high as the peripheral velocity of the contact transfer member 6*a*.

Besides, in order to prevent the soil of the back surface of the transfer medium 4, it is preferable to reduce the amount of toner to be transferred from the intermediate transfer medium 2 to the contact transfer member 6*a* in advance, and from this viewpoint, it is preferable to provide a resistance measuring unit for measuring the composite resistance of the secondary transfer area and an inverse transfer bias unit for setting the magnitude of the inverse transfer bias of the bias applying unit on the basis of the composite resistance measured by the resistance measuring unit.

Further, from the same viewpoint, it is preferable to provide an environmental information measuring unit for measuring environmental information, and an inverse transfer bias setting unit for setting the magnitude of the inverse transfer bias of the bias applying unit on the basis of the environmental information measured by the environmental information measuring unit.

First Embodiment

Figure 2:
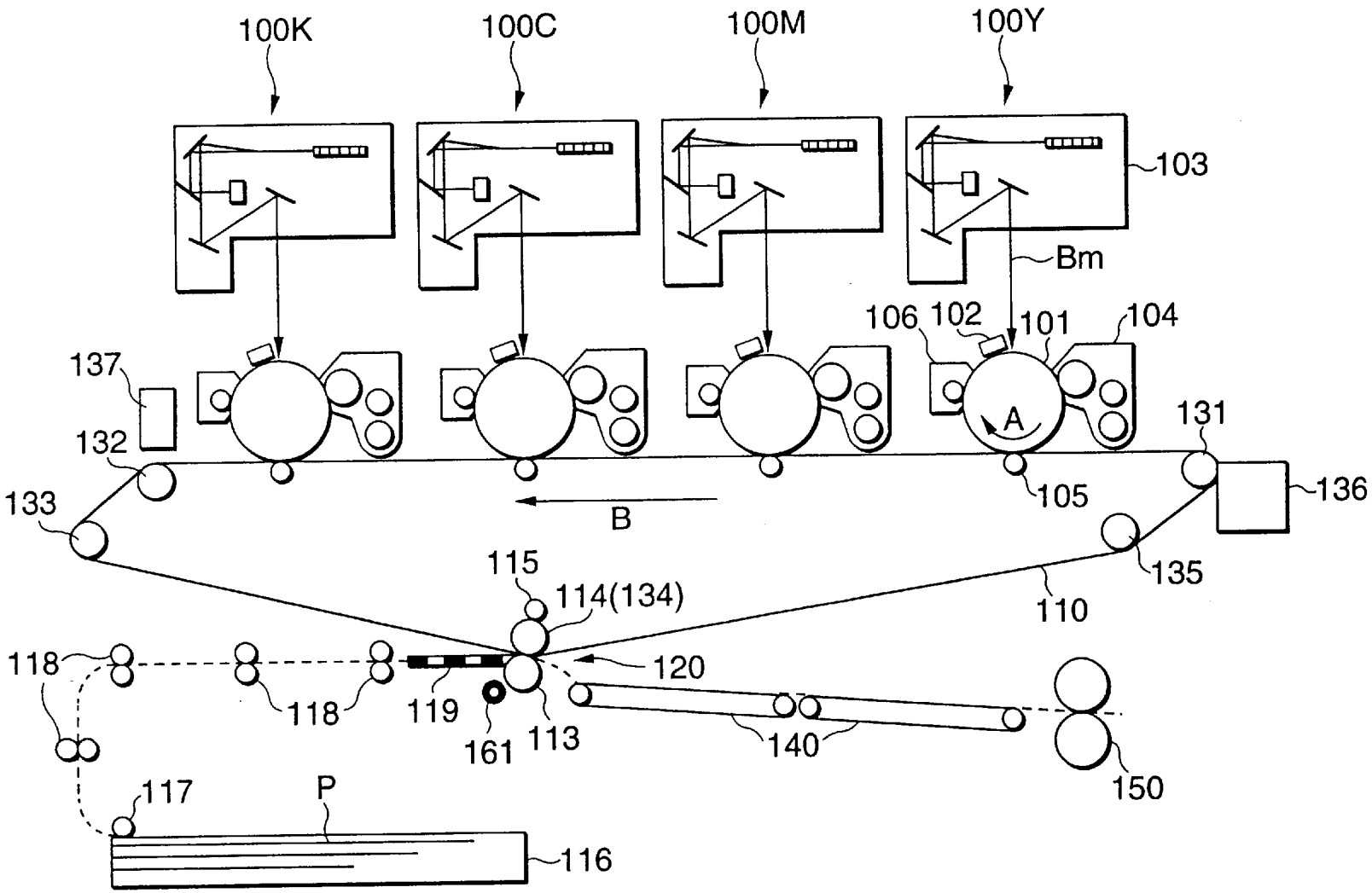
FIG. 2 shows the overall construction of a first embodiment of the image forming apparatus according to the present invention.

FIG. 2 shows a first embodiment of a color image forming apparatus according to the present invention.

In FIG. 2, the color image forming apparatus of this embodiment includes plural image forming units 100 (specifically, 100Y, 100M, 100C, 100K) on which toner images of respective color components are formed by electrophotography for example, an intermediate transfer belt 110 for successively transferring (primarily transferring) and holding the respective color component toner images formed in the respective image forming units 100, a collective transfer device 120 for collectively transferring onto a sheet P as a transfer medium images which are transferred on the intermediate transfer belt 110 while superposed on one another, and a fixing device 150 for fixing the collectively transferred images on the sheep P.

According to this embodiment, in each image forming unit 100, around a photosensitive drum 101 which rotates in the direction of an arrow A and serves as an image carrier are successively disposed various electrophotographic devices such as a uniform charger 102 for uniformly charging the photosensitive drum 101, a laser exposure 103 for writing an electrostatic latent image on the photosensitive drum 101 (in FIG. 2, an exposure beam is represented by Bm), a developing device 104 in which respective color toner components are stocked and which serves to convert an electrostatic latent image on the photosensitive drum 101 into a visual image, a primary transfer roll 105 as a primary transfer unit for transferring each color component toner image on the photosensitive drum 101 to an intermediate transfer belt 110, a drum cleaner 106 for removing residual toner on the photosensitive drum 101, etc.

The intermediate transfer belt 110 is suspended among plural (five in this embodiment) support rolls 131 to 135. Here, the support roll 131 is a driving roll for the intermediate transfer belt 110, the support roll 132 is a driven roll, the support roll 133 is a tension roll for adjusting the tension to be applied to the intermediate transfer belt 110, and the support roll 134 is a backup roll of the collective transfer device 120 as described later.

The intermediate transfer belt 110 is formed of resin such as polyimide, polyamide or the like in which a suitable amount of anti-charging agent such as carbon black or the like is added so that the volume resistance thereof is equal to $10^6$ to $10^{14}$ Ω·cm, and the thickness thereof is set to 0.1 mm.

A voltage having the same charging polarity as or the opposite charging polarity to the toner is applied to the primary transfer roll 105, whereby the toner images on the photosensitive drums 101 are successively electrostatically attracted to the intermediate transfer belt 110, and superposed toner images are formed on the intermediate transfer belt 110.

Further, the collective transfer device 120 has a secondary transfer roll 113 disposed so as to be pressed against the toner carrying surface side of the intermediate transfer belt 110, and a backup roll 114 which serves as a counter electrode to the secondary transfer roll 113 and is disposed at the back side of the intermediate transfer belt, and a metal power supply roll 115 to which a bias having the same polarity as the charging polarity of the toner is stably applied is disposed in contact with the backup roll 114.

In this embodiment, the secondary transfer roll 113 includes a urethane rubber tube dispersed with carbon in the surface thereof and a foamed urethane rubber core dispersed with carbon, and further fluoride coat is conducted on the surface of the roll so that the volume resistance thereof is equal to $10^3$ to $10^{10}$ Ω and the roll diameter thereof is equal to 28 mm. The hardness thereof is set to 30° (measured by ASKER C hardness meter), for example.

The backup roll 114 has a tube of blend rubber of EPDM and NBR dispersed with carbon in the surface thereof, and a EPDM rubber core. It is formed so that the surface resistivity thereof is equal to $10^7$ to $10^{10}$ Ω/□ and the roll diameter thereof is equal to 28 mm. The hardness thereof is equal to 70° (measured by ASKER C hardness meter), for example.

A brush roll 161 for removing the soil adhering to the secondary transfer roll 113 is disposed in contact with the secondary transfer roll 1×13. The brush roll 161 will be described in more detail later.

Reference numeral 136 represents a belt cleaner for cleaning the surface of the intermediate transfer belt 110 after the secondary transfer, and reference numeral 137 represents an image density sensor for image quality adjustment.

In this embodiment, the sheet feeding system picks up a sheet P from a sheet tray 116 at a predetermined timing by a pickup roll 117, and feeds out it through a feed roll 118 and a feeding chute 119 to the secondary transfer position. Thereafter, the sheet P after the secondary transfer is guided to the feeding belt 140, and then fed to the fixing device 150 by the feeding belt 140.

In this embodiment, a transfer bias control system for controlling the bias to be applied to the backup roll 114 is provided.

Figure 3:
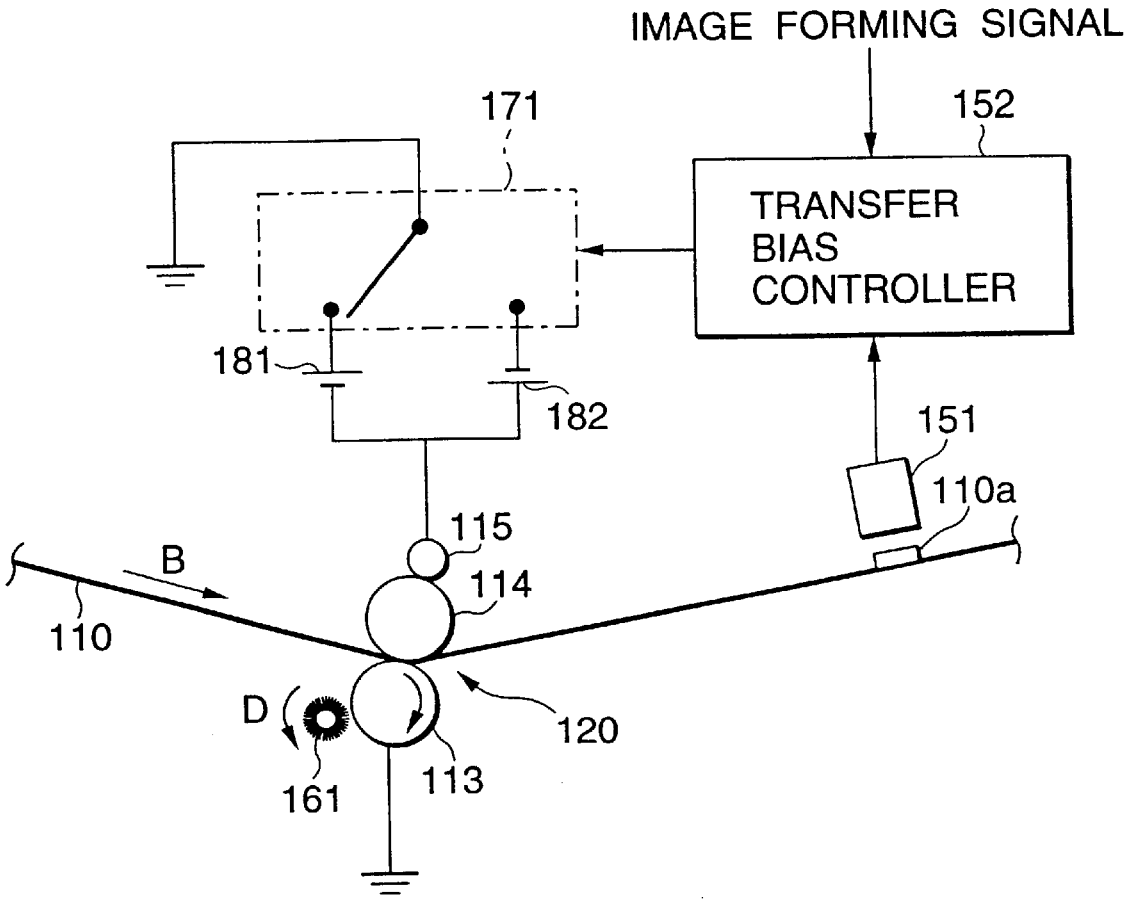
FIG. 3 is a block diagram showing a transfer bias control system used for the first embodiment.

As shown in FIG. 3, in the transfer bias control system, a belt position detection sensor 151 for detecting a reference position detecting projection 110*a* formed on the intermediate transfer belt 110 is mounted at the downstream side of the secondary transfer position, and the output from the belt position detecting sensor 151 and image forming signals such as the image size, etc. are taken into a transfer bias controller 152. In this transfer bias controller 152, the image transfer area and the image non-transfer area on the intermediate transfer belt 110 are specified on the basis of the detection result, and a transfer bias power source 181 for applying a transfer bias and an inverse transfer bias power source 182 for applying an inverse transfer bias are suitably switched to each other by the switch 171.

Next, the brush roll 161 will be described in detail.

Figure 4:
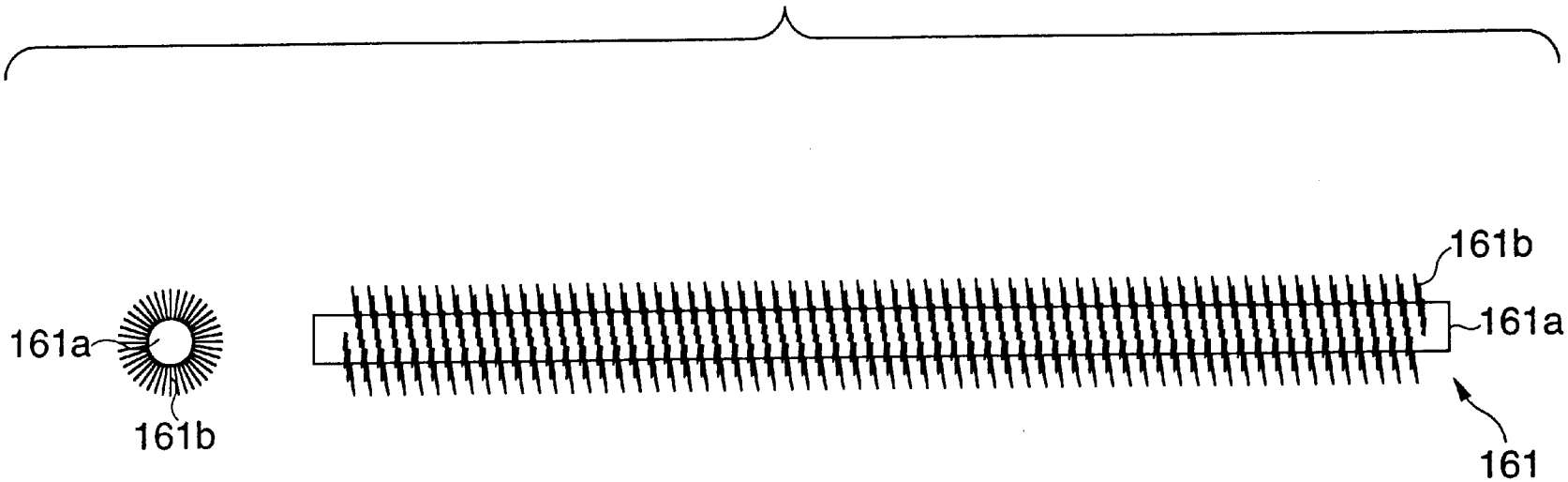
FIG. 4 shows a brush roll used in the first embodiment.

In this embodiment, the brush roll 161 is formed by planting a bundle of bristles 161*b* spirally on the surface of a roll-shaped shaft 161*a* formed of metal or having the same rigidity as metal as shown in FIG. 4, and the planting density thereof is set to 4650 bristles/$cm^2$.

The bristles 161*b* are formed of an insulating material which is liable to be charged at the same polarity as the toner in the electrification series. In this embodiment, polypropylene is used for the bristles 161*b*, and the resistance thereof is set to $10^{10}$ Ω·cm or more. However, the material of the bristles is not limited to polypropylene, but any material may be used insofar as it exhibits the same electrical characteristics (electrification series, resistance, etc.) as polypropylene.

In this embodiment, the diameter of the shaft 161*a* is set to 8 mm, the length of the bristles 161*b* is set to 7 mm, and the bite amount of the bristles 161*b* into the secondary transfer roll 113 is set to 1 mm.

Further, in this embodiment, the brush roll 161 is rotated interlockingly with the secondary transfer roll 113, and the rotational direction thereof is set to the same direction (D direction) as the rotational direction C of the secondary transfer roll 113 at the facing portion thereof to the secondary transfer roll 113 as shown in FIG. 3. The peripheral velocity of the brush roll 161 is set to be twice as fast as that of the secondary transfer roll 113.

Next, the image forming process of the color image forming apparatus according to this embodiment will be described.

When a start switch (not shown) is turned on, a predetermined working process is executed.

Describing specifically, when the color image forming apparatus is constructed as a digital color copying machine, an original put on an original table (not shown) is read out by a color image reading apparatus. Signals thus read out are converted to digital image signals by an image signal processor and then temporarily accumulated in a memory. The toner images of respective colors are formed on the basis of the digital image signals of four colors (Y, M, C, K) thus accumulated.

That is, the image forming units 100 (specifically, 100Y, 100M, 100C, 100K) are respectively driven in accordance with the digital image signals of the respective colors input from the image signal processor. In each image forming unit 100, an electrostatic latent image corresponding to each digital signal is written, by the laser exposure 103, on each photosensitive drum 101 which is uniformly charged by the uniform charger 102.

Each of these electrostatic latent images is developed by the developing device 104 in which the tone of each color is stocked, thereby forming each color toner image.

When the color image forming apparatus is constructed as a printer or the like, each color toner image may be formed on the basis of an image signal which is input from the external to the image signal processor.

The toner images formed on the photosensitive drums 101 are successively transferred from the photosensitive drum 101 to the surface of the intermediate transfer belt 110 by the primary transfer roll 105 at the primary transfer position at which each photosensitive drum 101 and the intermediate transfer belt 110 are brought into contact with each other. The residual toner on the photosensitive drum 101 after the primary transfer is removed by the drum cleaning 106.

The toner images which have been primarily transferred to the intermediate transfer belt 110 as described above are superposed on the intermediate transfer belt 110, and then fed to the secondary transfer position by the rotation of the intermediate transfer belt 110.

Besides, the sheet P is supplied to the secondary transfer position at a predetermined timing, and it is nipped by the secondary transfer roll 113 in cooperation with the backup roll 114.

At the secondary transfer position, the toner images carried on the intermediate transfer belt 110 are collectively transferred to the sheet P by the action of a transfer electric field formed between the secondary transfer roll 113 and the backup roll 114 as the collective transfer device 120. The sheet P having the toner images thus transferred thereto is fed to the fixing device 150 by the feeding belt 140 to fix the toner images on the sheet P.

The toner remaining on the intermediate transfer belt 110 after the secondary transfer is removed by the belt cleaner 136.

The above process is a normal sequential image forming process. However, in this embodiment, an image quality adjusting work is carried out to keep a high-quality image during the above sequential image forming process. The image quality adjusting work is carried out on the basis of a so-called feedback control operation in which an image quality adjusting image is formed in an area on the intermediate transfer belt 110 (image non-transfer area) where no image is transferred to the sheet P, and parameters of each image forming devices (in this embodiment, the image forming unit 100 constructed by the uniform charger 102, the laser exposure 103, the developing device 104, etc., for example) are re-set while monitoring the image quality adjusting image.

Next, the bias control for the secondary transfer portion to prevent the transfer of the image quality adjusting image to the secondary transfer roll 113 will be described hereunder.

Figure 5:
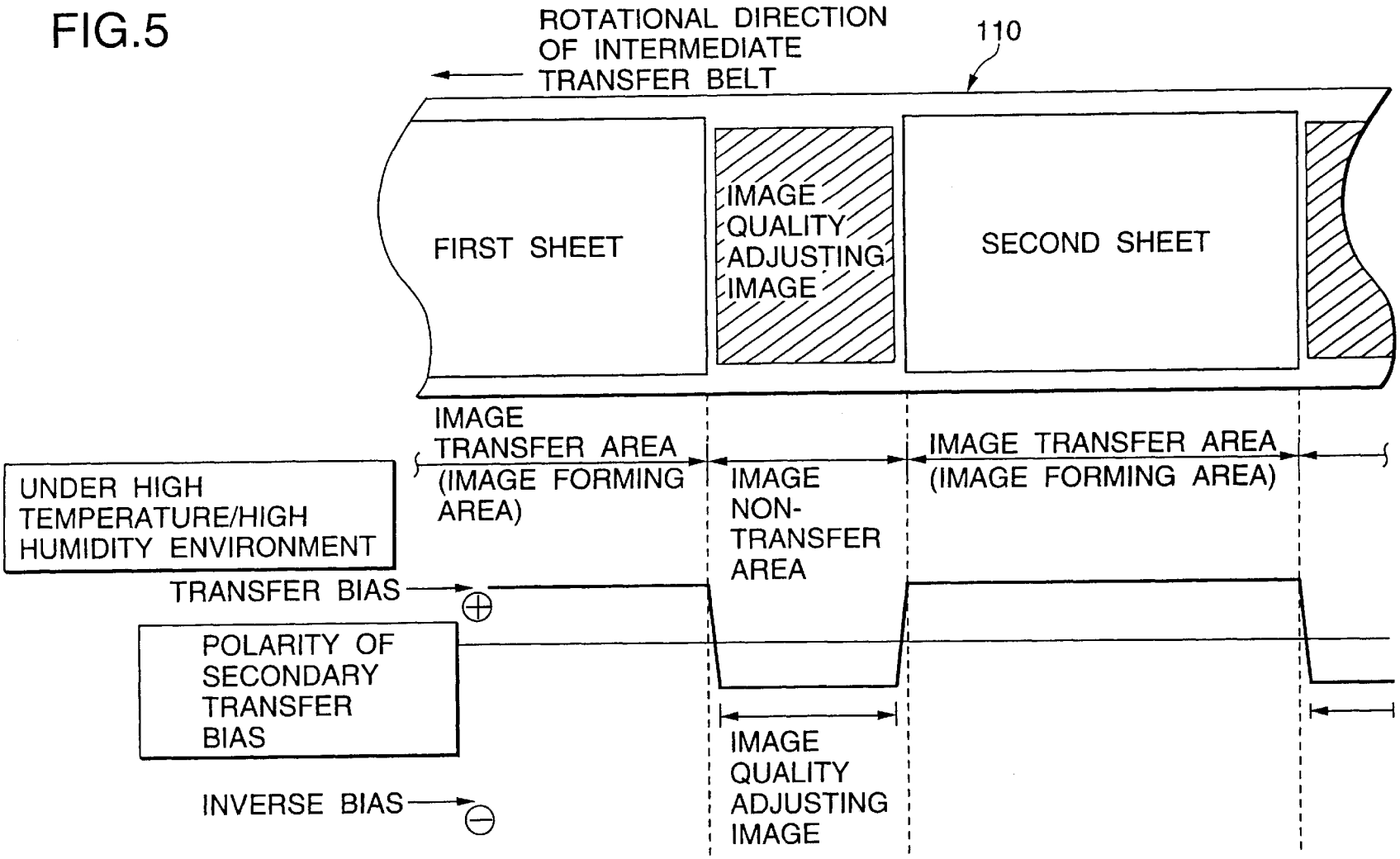
FIG. 5 is a diagram showing the relationship between an image forming position on an intermediate transfer belt and the polarity of a secondary transfer bias when the image forming area is passed through a secondary transfer portion.

FIG. 5 shows the relationship between the image forming position (upper stage) on the intermediate transfer belt 110 in this embodiment and the polarity (lower stage) of the secondary transfer bias to be applied when the image forming position is passed through the secondary transfer portion in this embodiment. In the following description, it is assumed that the area (the image transfer area) where the image is transferred to the sheet P is coincident to the size of the sheet P.

As shown in FIG. 5, the surface of the intermediate transfer belt 110 is divided into the image transfer area (image forming area) where the sheet P comes into contact with the intermediate transfer belt 110 and thus the image on the intermediate transfer belt 110 can be transferred to the sheet P, and the image non-transfer area where the sheet P does not come into contact with the intermediate transfer belt 110 and thus the image on the intermediate transfer belt 110 cannot be transferred to the sheet P.

An image to be transferred to the sheet P is primarily transferred to the image transfer area, that is, the image forming area, and then transferred to the sheet P in the secondary transfer portion.

On the other hand, an image quality adjusting image is also formed in the image forming unit 100 in the same process as the normal image forming process described above, and primarily transferred on the intermediate transfer belt 110. However, the image quality adjusting image is formed in the image non-transfer area.

As shown in FIG. 5, during a time period for which an image transfer area (image forming area) where a normal image for a first sheet P is formed is passed through the secondary transfer portion, the transfer bias power source 181 is turned on, and the transfer bias is applied to transfer the image onto the sheet P. Thereafter, after the image transfer area concerned has been passed through the secondary transfer portion, the transfer bias power source 181 is turned off, and at the same time the inverse transfer bias power source 182 is turned on to apply the inverse transfer bias. The inverse transfer bias is applied during a time period for which an image non-transfer area where an image quality adjusting image exists is passed through the secondary transfer portion. Accordingly, during this time period, the image quality adjusting image on the intermediate transfer belt 110 is hard to transfer onto the secondary transfer roll 113.

Subsequently, after the image non-transfer area containing the image quality adjusting image has been passed through the secondary transfer portion, the inverse transfer bias power source 182 is turned off an d at the same time the transfer bias power source 181 is turned on to apply the transfer bias just before an image transfer area (image forming area) for a second sheet P arrives at the secondary transfer portion. Therefore, during a time period for which the image transfer area (image forming area) for the second sheet P is passed through the secondary transfer portion, the transfer bias is applied again to transfer an image onto the second sheet P.

The image quality adjusting image remaining on the intermediate transfer belt 110 is removed by the belt cleaner 136 of the intermediate transfer belt 110.

However, there might occur such a situation that the overall image quality adjusting image cannot be kept on the intermediate transfer belt 110 and thus a part of the image quality adjusting image (residual toner) is transferred to the secondary transfer roll 113 in a case where the image density of the image quality adjusting image is high or the image area is large and thus the toner amount is large although the inverse transfer bias is applied to the image non-transfer area.

However, according to this embodiment, the brush roll 161 is rotated while being in contact with the secondary transfer roll 113, so that the transferred toner on the surface of the secondary transfer roll 113 is disturbed (removed or disturbed) by the bristles 161*b* to the extent that the transferred toner is unrecognizable as an image. As a result, even when the secondary transfer roll 113 abuts against a next sheet P and toner is transferred from the secondary transfer roll 113 to the sheet P, the toner is unrecognizable as soil (image) because it is disturbed, so that any situation that the soil of the back surface of a sheet is troublesome does not occur.

Further, in this embodiment, since the bristles 161*b* of the brush roll 161 are formed of insulating material which is liable to be charged at the same polarity as the toner, the toner on the secondary transfer roll 113 are not adsorbed by the bristles 161*b*, and thus the toner on the secondary transfer roll 113 can be prevented from being adsorbed by the bristles 161*b* and then re-transferred to the secondary transfer roll 113. In addition, the toner can be prevented from being trapped between the bristles 161*b*. Therefore, there is unnecessary to provide a member for removing the trapped toner, and thus the bristles 161*b* can be avoided from being worn out, so that the lifetime of the brush roll 161 can be lengthened.

In order to determine the optimum planting condition of the bristles 161*b* of the brush roll 161, the inventor of this application has made examinations on various brush rolls 161 different in planting density.

Figure 6:
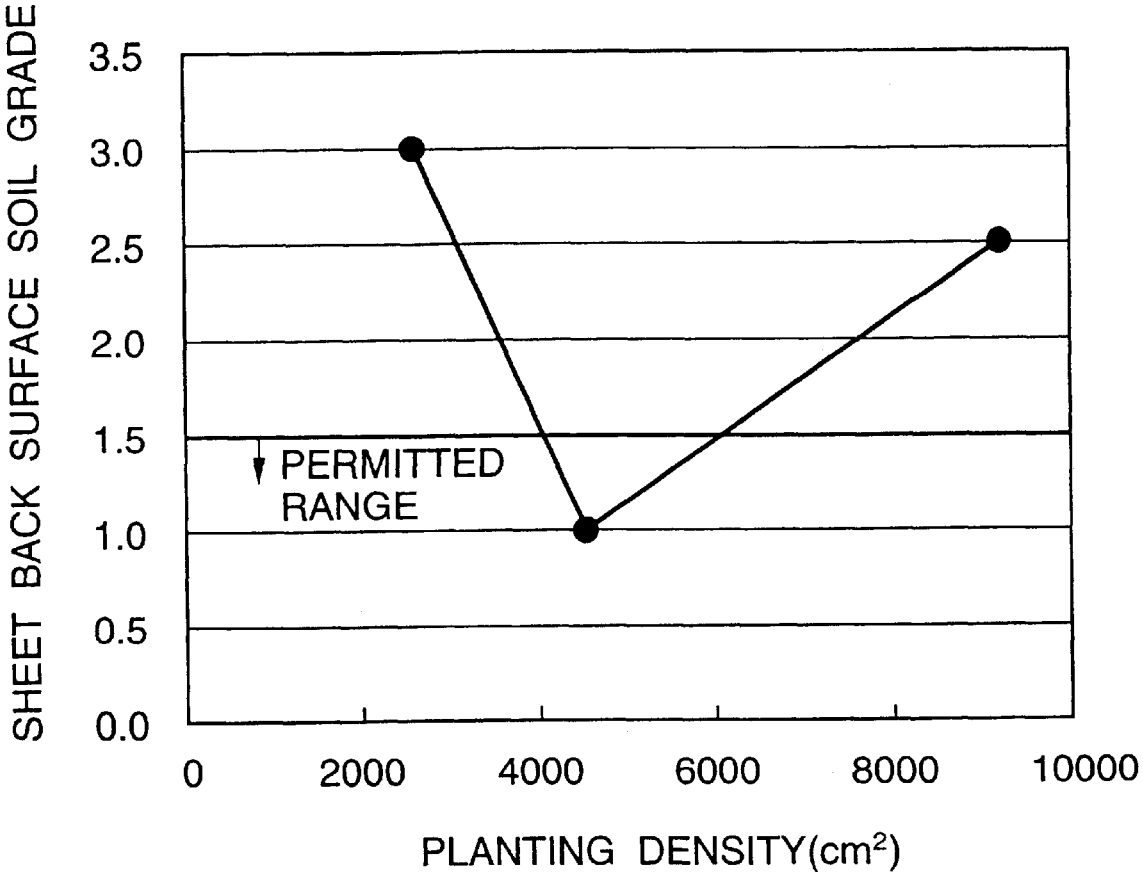
FIG. 6 is a graph showing the relationship between the planting density of the brush roll and he soil grade on the back surface of a sheet.

FIG. 6 shows examination results of the relationship between the planting density and the soil grade (level) of the back surface of the sheet.

Here, "0" in the soil grade of the sheet back surface represents the level that the sheet has no soil, "1" represents the level that soil is recognized by using a magnifier, "1.5" represents the level that soil induces no practical trouble, and "2" represents the level that the soil is critical, and "3" represents that the soil is very critical.

As is apparent from the graph of FIG. 6, when the planting density is excessively small, the toner disturbing power is insufficient, and thus soil occurs on the back surface of the sheet. Conversely, when the planting density is excessively large, the toner is trapped between the bristles of the brush roll and soil occurs on the back surface of the sheet due to the trapped toner. Accordingly, it is preferable that the planting density of the bristles 161*b* is set to a value in the range from 3875 bristles/$cm^2$ to 6200 bristles/$cm^2$.

Further, in order to determine the optimum condition on the ratio between the peripheral velocity of the secondary transfer roll 113 and the peripheral velocity of the brush roll 161 (peripheral velocity ratio), the inventor has made examinations on variation of the peripheral velocity ratio.

Figure 7:
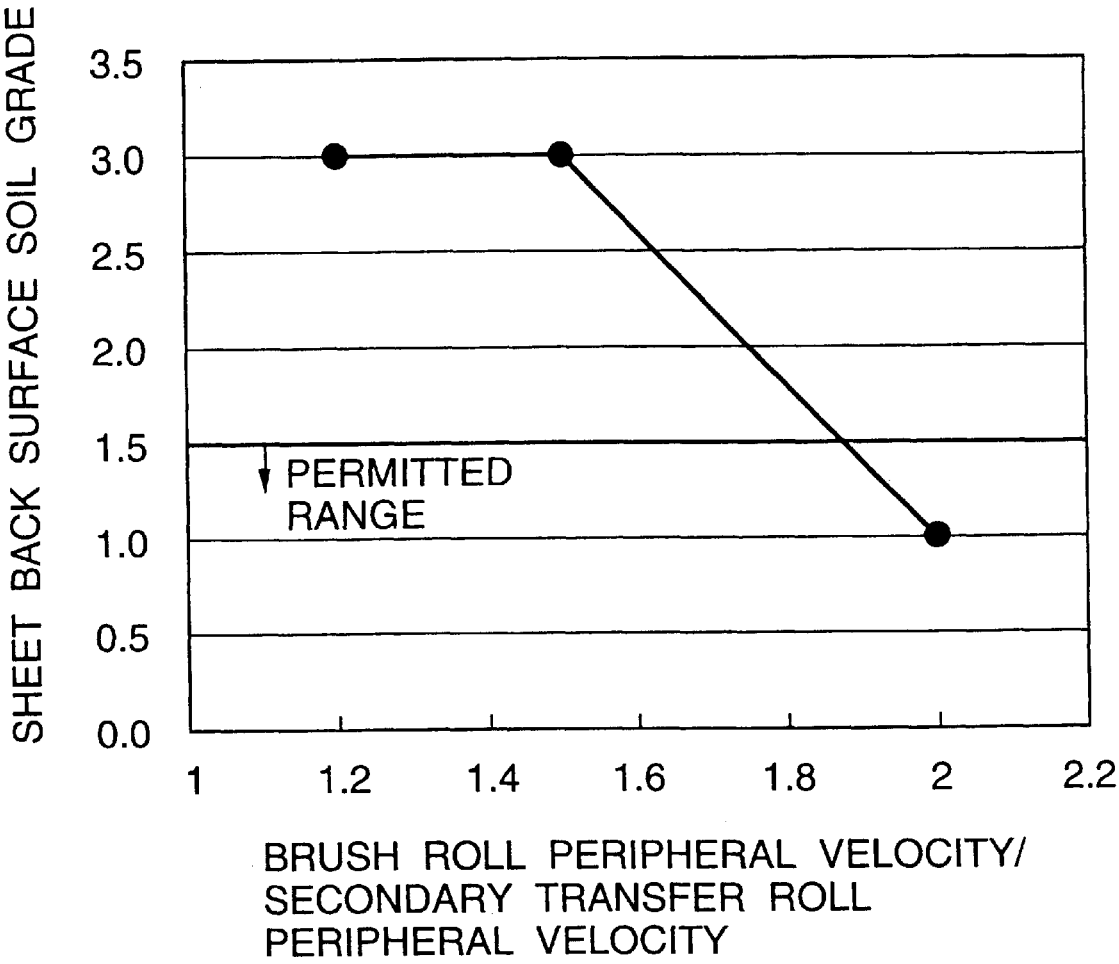
FIG. 7 is a graph showing the relationship between the ratio of the peripheral velocity between the brush roll and the secondary transfer roll and the soil grade of the back surface of the sheet.

FIG. 7 shows examination results showing the relationship between the peripheral velocity ratio of the secondary transfer roll and the brush roll 161 and the soil grade of the sheet back surface.

As is apparent from the graph of FIG. 7, when the peripheral velocity of the brush roll is lower than that of the secondary transfer roll 113 the toner disturbing power is reduced and thus soil occurs on the back surface of the sheet P. However, when the peripheral velocity ratio is set to twice or more, the toner disturbing power is sufficient and thus no soil occurs on the back surface of the sheet P. Therefore, the peripheral velocity of the brush roll 161 is preferably set to two or more times as fast as that of the secondary transfer roll 113.

Second Embodiment

Figure 8:
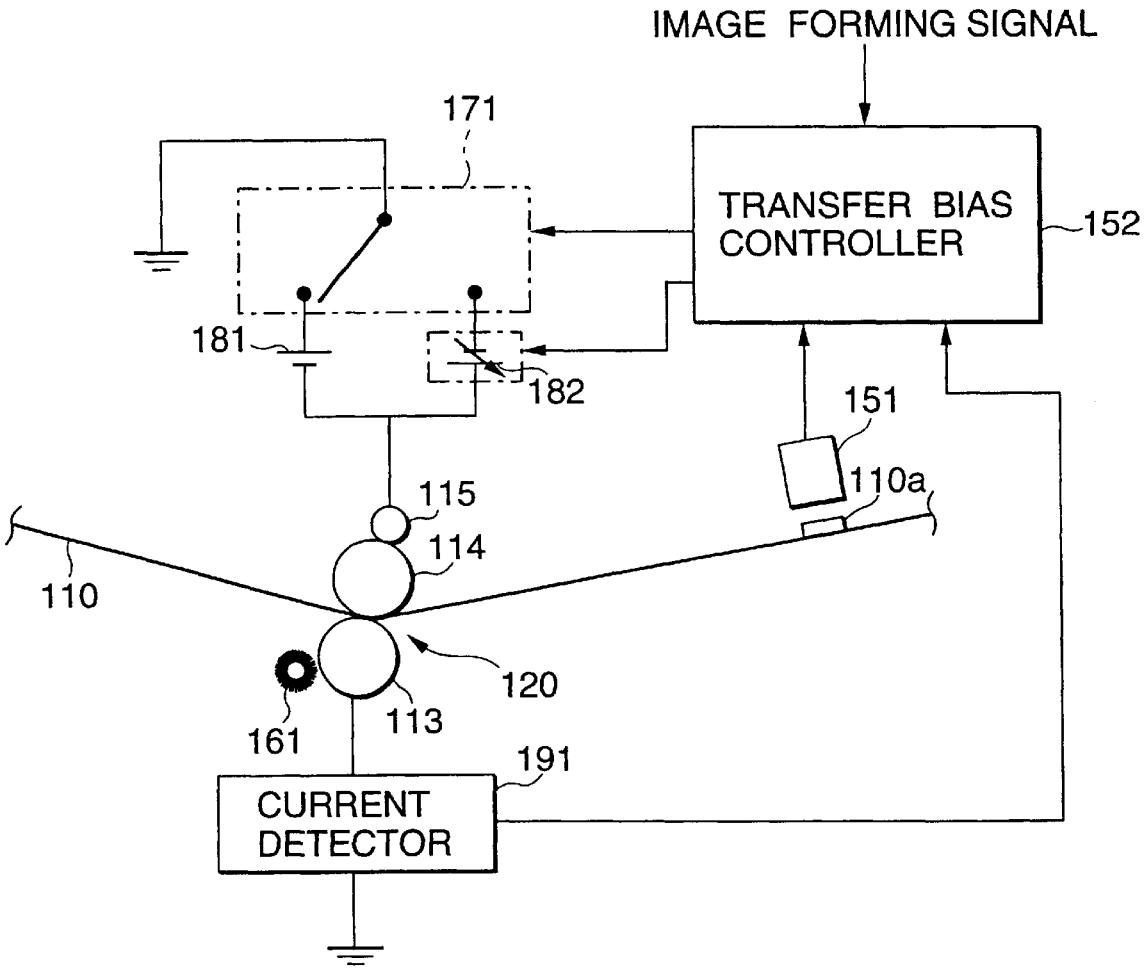
FIG. 8 is a block diagram showing a transfer bias control system used in a second embodiment.

The second embodiment is substantially the same as the first embodiment except that a current detector 191 for detecting current flowing in the secondary transfer portion is provided and the inverse transfer bias is set in accordance with the system resistance of the secondary transfer portion as shown in FIG. 8.

The similar elements as those of the image forming apparatus of the first embodiment are represented by the same reference numerals, and the detailed description thereof is omitted from the following description.

In the second embodiment, the current flowing in the current detector 191 when the transfer bias is applied is detected, the system resistance of the secondary transfer portion is calculated on the basis of the voltage of the transfer bias power source 181 and the current flowing in the current detector 191. The inverse transfer bias output value (applied voltage) of the inverse transfer bias power source 182 when the inverse transfer bias is applied is variably set on the basis of the system resistance thus calculated.

Figure 9:
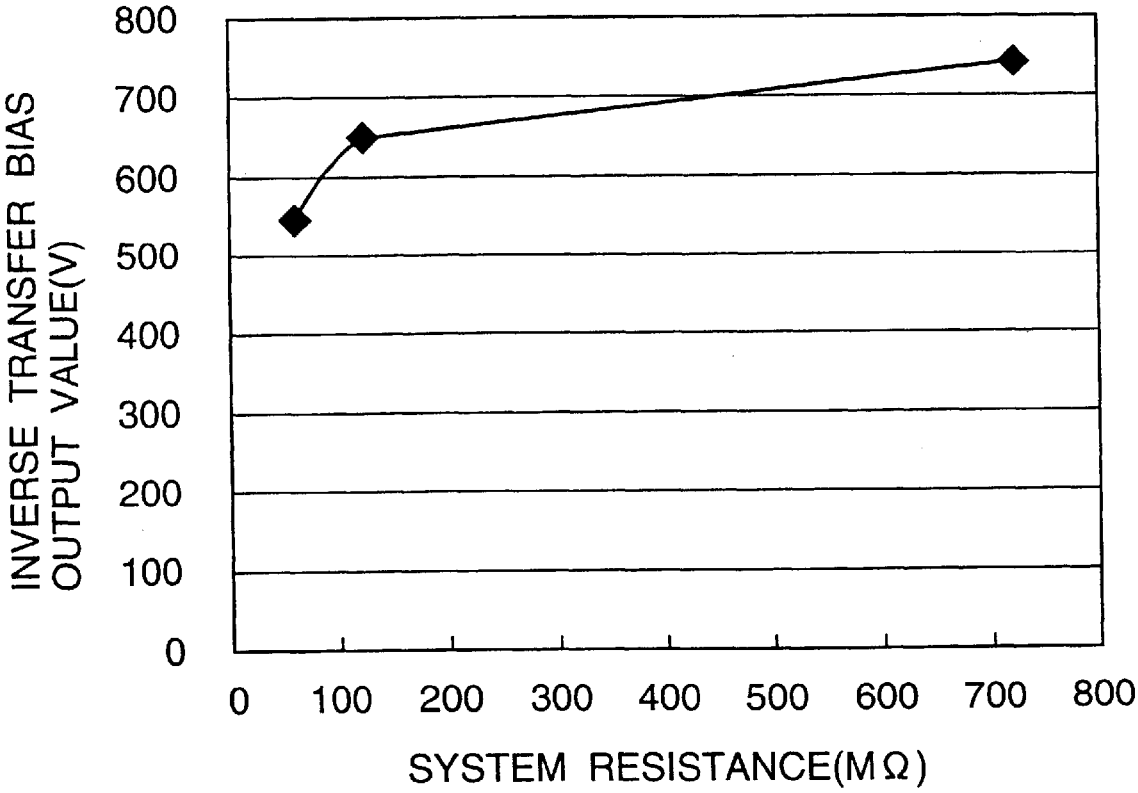
FIG. 9 is a graph showing the relationship between the system resistance and the optimum inverse transfer bias output value.
Figure 10:
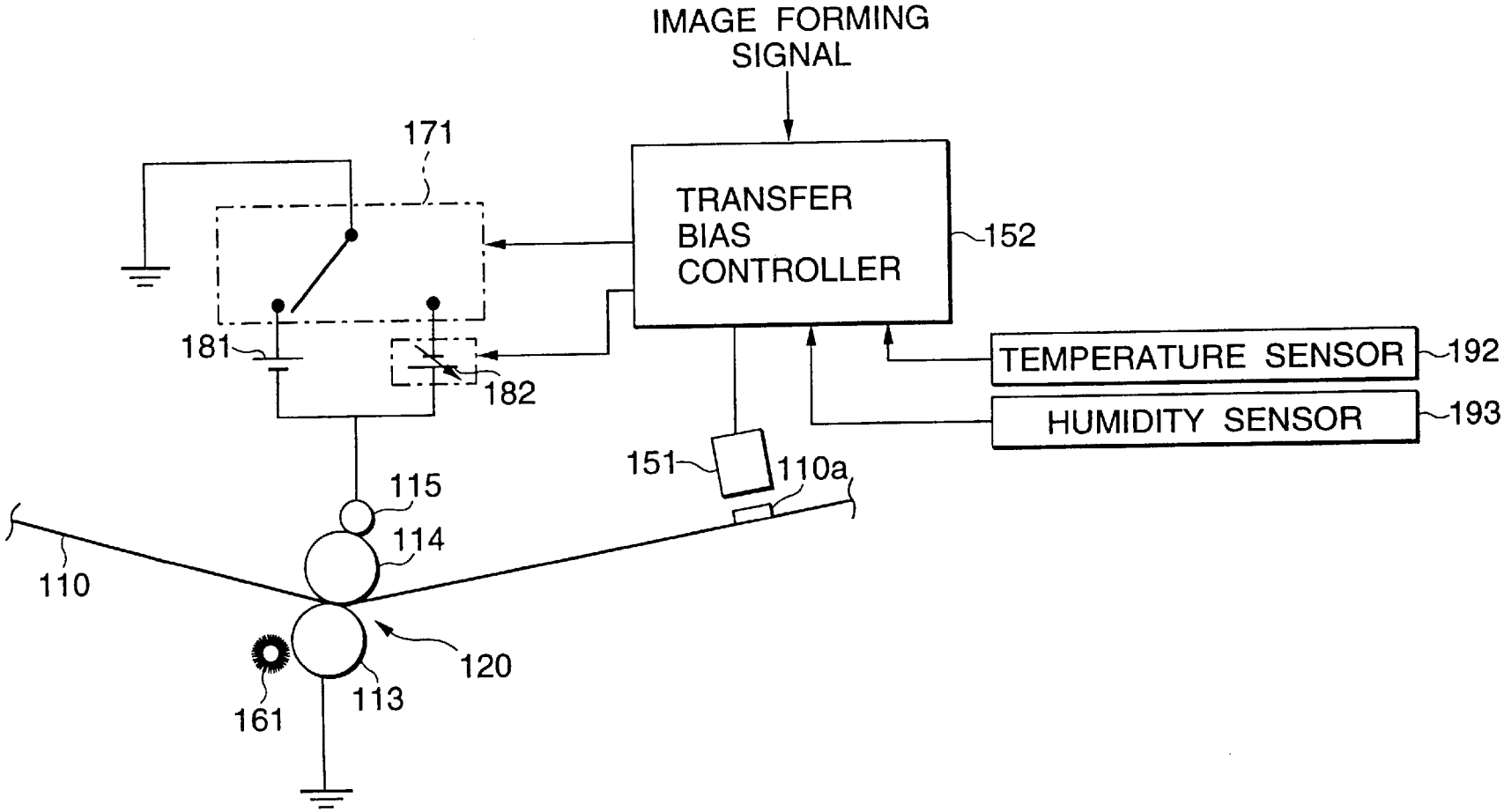
FIG. 10 is a block diagram showing a transfer bias control system used in a third embodiment.

Here, on the basis of the examinations of the inventor, it has been found that the relationship shown in FIG. 9 is established between the system resistance and the optimum inverse transfer bias.

In this embodiment, the inverse transfer bias output value is set to the optimum value in accordance with the system resistance, so that the image quality adjusting image formed on the image non-transfer area can be further suppressed from being transferred to the secondary transfer roll 113 and thus the back surface of the sheet P can be more effectively prevented from being soiled.

Third Embodiment

The third embodiment is substantially the same as the first embodiment except that a temperature sensor 192 and a humidity sensor 193 for detecting the surrounding environment (environmental temperature and humidity) are provided and the inverse transfer bias is set in accordance with the environmental condition.

The similar elements to those of the image forming apparatus of the first embodiment are represented by the same reference numerals, and the detailed description thereof is omitted from the following description.

In this embodiment, the inverse transfer bias output value (applied voltage) of the inverse transfer bias power source 182 when the inverse transfer bias is applied is variably set on the basis of a temperature detection signal from the temperature sensor 192 and a humidity detection signal from the humidity sensor 193.

Figure 11:
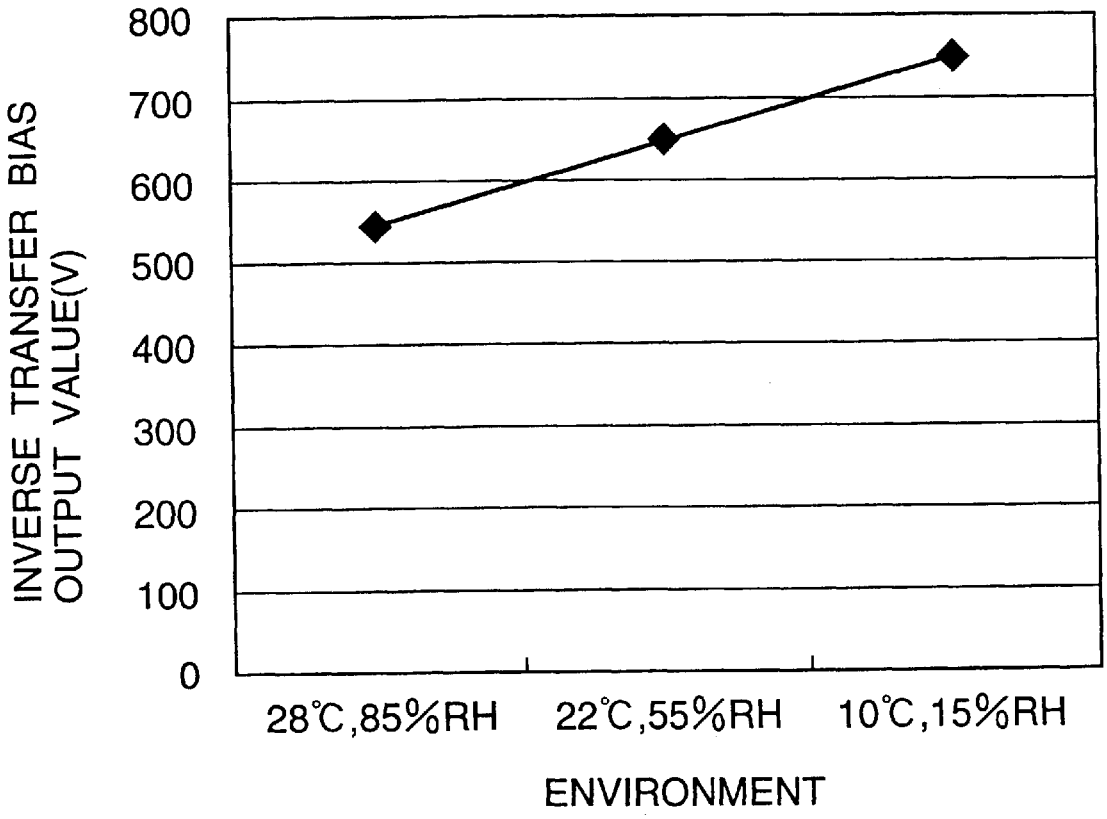
FIG. 11 is a graph showing the relationship between the environmental condition and the optimum inverse transfer bias output value.

Here, on the basis of the inventor's examinations, it has been found that the relationship shown in FIG. 11 is established between the environmental condition and the optimum inverse transfer bias. In FIG. 11, the results of only three conditions are representatively shown.

In this embodiment, the inverse transfer bias output value is set to the optimum value in accordance with the environmental condition, and thus the image quality adjusting image formed on the image non-transfer area can be further prevented from being transferred to the secondary transfer roll 113, so that the back surface of the sheet P can be more effectively prevented from being soiled.

As described above, according to the present invention, the toner transferred to the contact transfer member is disturbed by the disturbing member, so that the back surface of a next transfer medium can be more effectively prevented from being soiled by an image quality adjusting image transferred to a contact transfer member.

What is claimed is:

1. An image forming apparatus comprising:

an image carrier on which a toner image corresponding to image information is formed;

an intermediate transfer medium disposed to face the image carrier;

a primary transfer unit that transfers the toner image on the image carrier onto the intermediate transfer medium;

a secondary transfer unit that transfers the toner image on the intermediate transfer medium onto a transfer medium, the secondary transfer unit comprising a secondary transfer member having a contact transfer member which is disposed in contact with at least the surface of the intermediate transfer medium, a bias applying unit that applies a transfer bias to transfer the toner image on the intermediate transfer medium through the secondary transfer member to the transfer medium and an inverse transfer bias having the opposite polarity to the transfer bias, and a bias switching unit which switches the bias to be applied by the bias applying unit to apply the transfer bias to an image transfer area on the intermediate transfer medium and apply the inverse transfer bias to at least a part of an image non-transfer area on the intermediate transfer medium;

a disturbing member which is formed of an insulator disposed in contact with the contact transfer member and disturbs the toner adhering to the contact transfer member;

a resistance measuring unit that measures a composite resistance of secondary transfer area; and an inverse bias setting unit that sets the magnitude of the inverse transfer bias of the bias applying unit on the basis of the composite resistance measured by the resistance measuring unit.

2. The image forming apparatus as claimed in claim 1, wherein the disturbing member is formed of a material which is charged at the same polarity as toner with which the toner image is formed.

3. The image forming apparatus as claimed in claim 1, wherein the disturbing member is formed of a brush roll which is rotatably disposed.

4. The image forming apparatus as claimed in claim 3, wherein the bundle of bristles of the brush roll is planted spirally with respect to a rotational direction of the brush roll.

5. The image forming apparatus as claimed in claim 3, wherein the planting density of the brush roll is set to a value in the range from 3875 bristles/cm$^2$ to 6200 bristles/cm$^2$.

6. The image forming apparatus as claimed in claim 3, wherein the brush roll is rotated in the same direction as the contact transfer member at a position facing the contact transfer member.

7. The image forming apparatus as claimed in claim 6, wherein the peripheral velocity of the brush roll is set to be twice as fast as that of the contact transfer member.

8. The image forming apparatus as claimed in claim 1, wherein the disturbing member disturbs the toner adhering to the contact transfer member without moving the toner substantially to the disturbing member.

9. An image forming apparatus comprising:

an image carrier on which a toner image corresponding to image information is formed;

an intermediate transfer medium disposed to face the image carrier;

a primary transfer unit that transfers the toner image on the image carrier onto the intermediate transfer medium;

a secondary transfer unit that transfers the toner image on the intermediate transfer medium onto a transfer medium, the secondary transfer unit comprising a secondary transfer member having a contact transfer member which is disposed in contact with at least the surface of the intermediate transfer medium, a bias applying unit that applies a transfer bias to transfer the toner image on the intermediate transfer medium through the secondary transfer member to the transfer medium and an inverse transfer bias having the opposite polarity to the transfer bias, and a bias switching unit which switches the bias to be applied by the bias applying unit to apply the transfer bias to an image transfer area on the intermediate transfer medium and apply the inverse transfer bias to at least a part of an image non-transfer area on the intermediate transfer medium;

a disturbing member which is formed of an insulator disposed in contact with the contact transfer member and disturbs the toner adhering to the contact transfer member;

an environmental information measuring unit that measures environmental information; and an inverse transfer bias setting unit that sets the magnitude of the inverse transfer bias of the bias applying unit on the basis of the environmental information measured by the environmental information measuring unit.

10. The image forming apparatus as claimed in claim 9, wherein the disturbing member is formed of a brush roll, which is rotatably, disposed.

11. The image forming apparatus as claimed in claim 10, wherein the bundle of bristles of the brush roll is planted spirally with respect to a rotational direction of the brush roll.

12. The image forming apparatus as claimed in claim 10, wherein the planting density of the brush roll is set to a value in the range from 3875 bristles/$cm^2$ to 6200 bristles/$cm^2$.

13. The image forming apparatus as claimed in claim 10, wherein the brush roll is rotated in the same direction as the contact transfer member at a position facing the contact transfer member.

14. The image forming apparatus as claimed in claim 13, wherein the peripheral velocity of the brush roll is set to be twice as fast as that of the contact transfer member.

* * * * *